US009486122B2

(12) United States Patent
Renato

(10) Patent No.: US 9,486,122 B2
(45) Date of Patent: Nov. 8, 2016

(54) MOP BASE

(76) Inventor: Zorzo Renato, Onara (IT)

( * ) Notice: Subject to any disclaimer, the term of this patent is extended or adjusted under 35 U.S.C. 154(b) by 287 days.

(21) Appl. No.: 14/241,231

(22) PCT Filed: Jul. 30, 2012

(86) PCT No.: PCT/IB2012/053892

§ 371 (c)(1),
(2), (4) Date: Feb. 26, 2014

(87) PCT Pub. No.: WO2013/018023

PCT Pub. Date: Feb. 7, 2013

(65) Prior Publication Data

US 2015/0007403 A1 Jan. 8, 2015

(30) Foreign Application Priority Data

Aug. 3, 2011 (IT) ..... PD2011A0260

(51) Int. Cl.

| | |
|---|---|
| ***A47L 13/256*** | (2006.01) |
| ***A47L 13/258*** | (2006.01) |
| ***A47L 13/146*** | (2006.01) |
| ***A47L 13/44*** | (2006.01) |

(52) U.S. Cl.
CPC ..... *A47L 13/256* (2013.01); *A47L 13/146* (2013.01); *A47L 13/258* (2013.01); *A47L 13/44* (2013.01)

(58) Field of Classification Search
CPC .. A47L 13/146; A47L 13/258; A47L 13/256
See application file for complete search history.

(56) References Cited

U.S. PATENT DOCUMENTS

2007/0107153 A1* 5/2007 Gullicks ..... A47L 13/258 15/147.1

FOREIGN PATENT DOCUMENTS

| | | | |
|---|---|---|---|
| CA | 2 569 087 | * | 12/2005 |
| DE | 29512724 | U1 | 10/1995 |
| EP | 1 245 179 | * | 10/2002 |
| GB | 2450730 | A | 1/2009 |
| WO | 03039321 | A1 | 5/2003 |
| WO | 2006002653 | A1 | 1/2006 |
| WO | 2006002654 | A1 | 1/2006 |

* cited by examiner

*Primary Examiner* — Randall Chin
(74) *Attorney, Agent, or Firm* — QUICKPATENTS, LLC; Kevin Prince

(57) ABSTRACT

Improved mop base capable of using both surfaces of a normal mop arranged parallel to one another.

15 Claims, 7 Drawing Sheets

MOP BASE

CROSS-REFERENCE TO RELATED APPLICATIONS

This application claims the benefit of Italian Patent Application PD2011A000260, filed on Aug. 3, 2011, and PCT Application PCT/IB2012/053892, filed on Jul. 30, 2012, both incorporated herein by reference.

STATEMENT REGARDING FEDERALLY SPONSORED RESEARCH AND DEVELOPMENT

Not Applicable.

FIELD OF THE INVENTION

This invention relates to mops, and more particularly to a mop base.

DISCUSSION OF RELATED ART

It is well known that the devices for holding cleaning mops, generally known by the name mop base, have over time become devices that manufacturers have paid a great deal of attention to in order to satisfy user requirements, with particular reference to ease of use, practicality of use, and ease of handling and cleaning.

Naturally over the years various manufacturers, emphasizing one aspect over others, have made various kinds of bases for mops.

One characteristic that users of mops have greatly appreciated has been that which would allow the mop to be held, also when the mop base was not on the floor, so that it can, without handling the mop itself with one's hands, be put back inside its container after the cleaning has been carried out, and therefore with the mop dirty.

Another mop base model prioritized the possibility of being able to wring the mop attached to it, while keeping it attached to the base itself.

Other models, with the aim of using both surfaces of the mop, have been designed so that they can easily be turned over.

Mop base configurations have taken forms with long-limbed profiles and connected with curvatures that impede undesired interference with objects in the cleaning area because they do not have parts that stick out.

Other models, lastly, have been designed in such a way as to better respond to a specific requirement of the user, but at the same time becoming particularly complex and neglecting the other aspects of practicality, which are still very much valued.

SUMMARY OF THE INVENTION

The main purpose of this invention is to make available a mop base that can be easily used, overcoming the drawbacks of the prior art.

Another purpose of this invention is to make available a mop base that can keep the mop attached to it also when the mop base is raised from the floor.

Another purpose of this invention is to make available a mop base that can easily be put inside a wringer, together with the mop.

Another purpose of this invention is to make available a mop base whose kinematic release system is simple to activate and which does not stick out when the mop is being used.

Another purpose of this invention is to make available a mop base that can also be used in narrow spaces without any danger that it could get caught and/or that it could notify the operator the possibility of entering narrow and small spaces and the guarantee that once having gone in it can get out without any snags.

These and other purposes are all attained with the improved mop base, according to the attached claims.

Said mop base also attains other purposes that will be pointed out in this description.

The object of the invention is a frame composed of a pair of half-frames basically flat facing one another and hinged together roughly in their central part along a common longitudinal axis and capable of retaining a free edge of a mop inside a clasping mouth composed a pair of longitudinal edges, belonging to the same side of each half-frame, where said kinematic system, which can take on two configurations, the first closed, with the gripping mouth holding a mop, and a second configuration that is open with the gripping mouth open, with the particularity that the two half-frames in the closed and stable configuration take on an arrangement with their larger outer surfaces being parallel.

An important advantage of the device of this invention is the uncoupling element that is kept inside the two half-frames, suitable for keeping the open state between the two half-frames stable.

An example of such an uncoupling element is shown in Patent Application PD2011A000259, which is included for reference purposes.

This absence of protruding parts usefully allows the device that is the object of the invention to wring the mop it is fitted with, even when fixed to at least one of the outer surfaces of a half-frame, without the drawback of an undesired uncoupling or release of the mop gripped in its mouth.

Beneficially, this wringing of the mop on an outer surface of a half-frame of the mop base is carried out inside a wringer for flat surfaces, with the outer surfaces of the half-frames being parallel to one another and they do not change their position following the pressure exercised by the wringer for wringing the mop.

Another advantage is that the uncoupling element rises above the height of its rest position when the two half-frames are inclined to take on their maximum open position.

Another feature of the frame is that this frame can be freely rotated to use both sides of the mop attached to it, with every outer surface of the half-frame being flat and suitable for the purpose, defined as an active surface.

Beneficially the frame can take on the open state following the pressure exercised on the end part (overhanging with respect to the hinging between the half-frames) of a half-frame (preferably the one that has the apertures for housing the uncoupling elements and from which they come out).

The return to the closed state, starting from an open state, occurs through simple pressure on one of the uncoupling elements, which by removing the constraint allows the elastic components to rotate the half-frames for the closing of the mouth.

DESCRIPTION OF THE DRAWINGS

The technical characteristics of the invention, according to the above-mentioned purposes, can clearly be seen in the claims below, and the advantages will be clearer in the detailed description that follows, made with reference to the attached diagrams, which depict it in a form that is purely by way of example and non-limiting, where:

DETAILED DESCRIPTION OF THE PREFERRED EMBODIMENT

Figure 1:
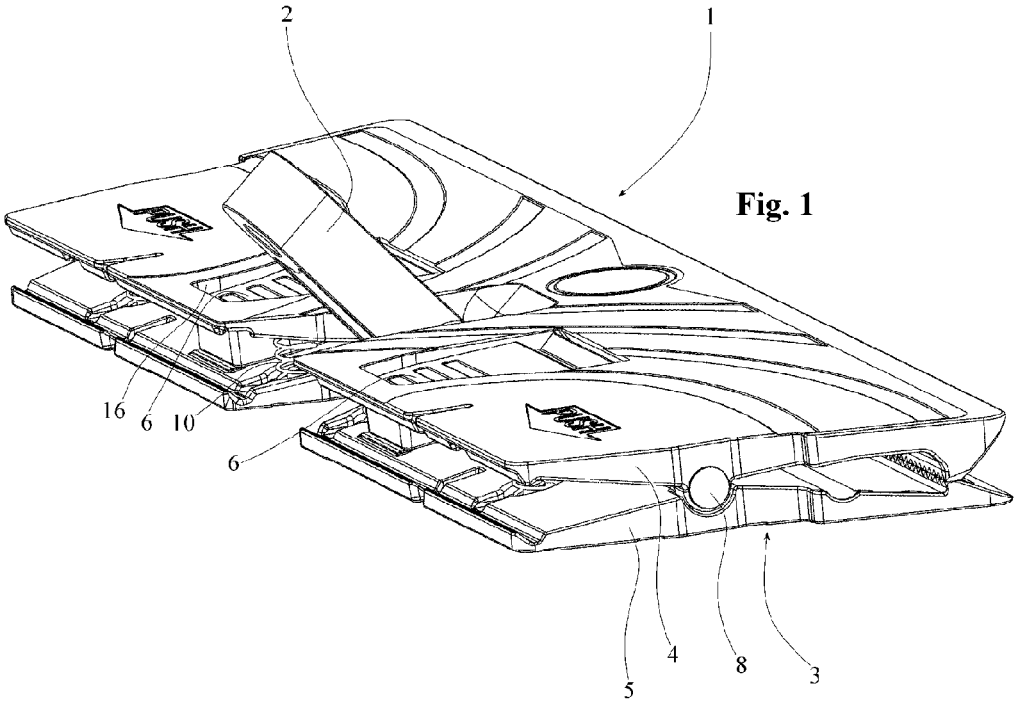
FIGS. 1 and 2 show an axonometric view of the frame that is the object of the invention in a closed and open condition respectively.
Figure 2:
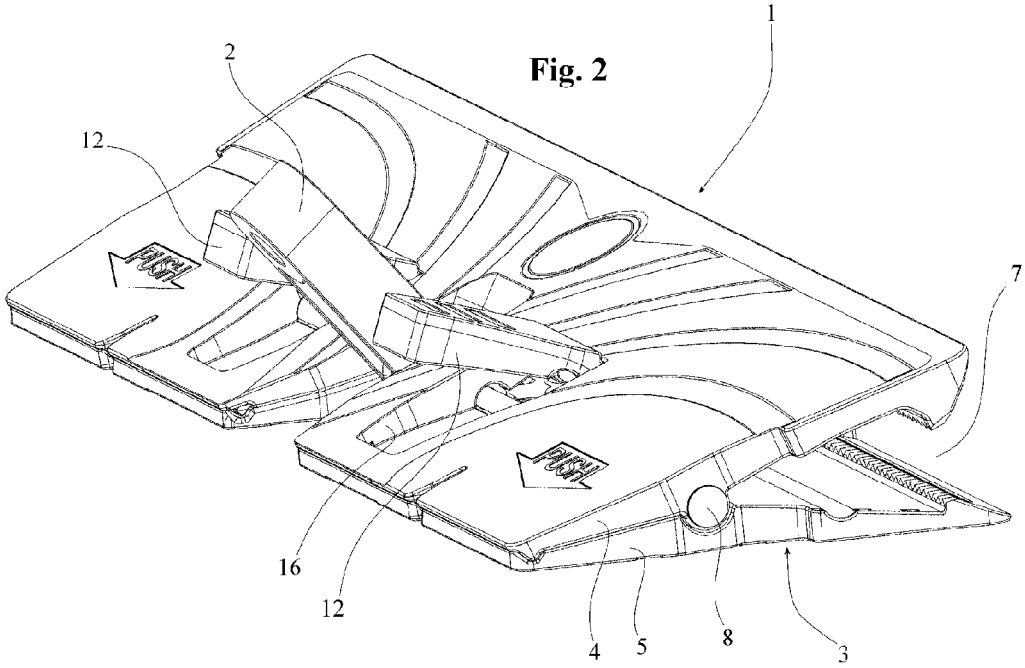
Figure 3:
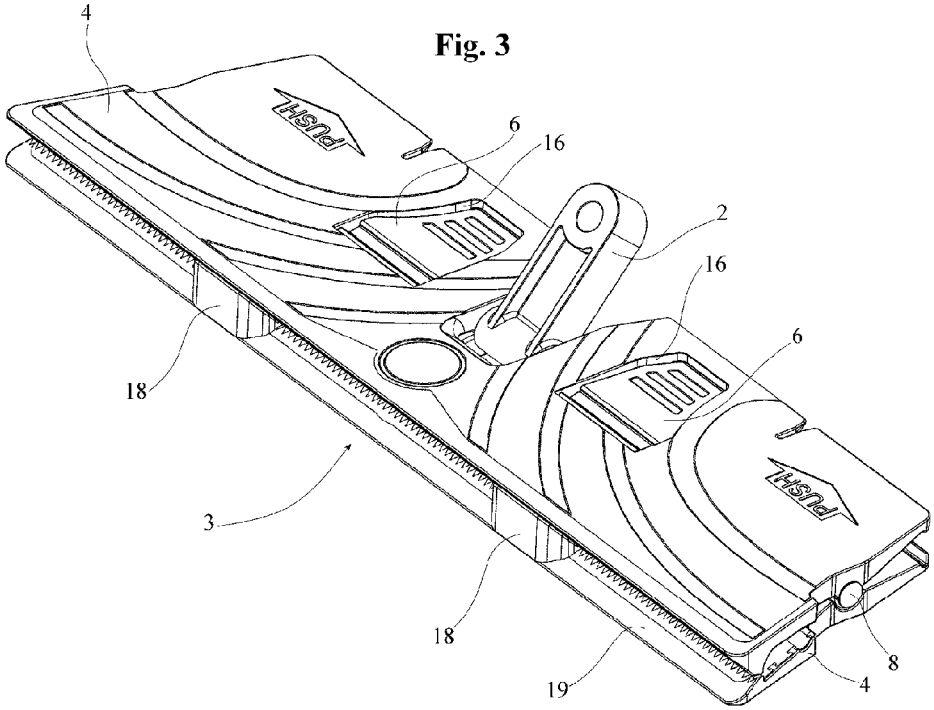
FIGS. 3 and 4 show a second axonometric view of the frame that is the object of the invention in a closed and open condition.
Figure 4:
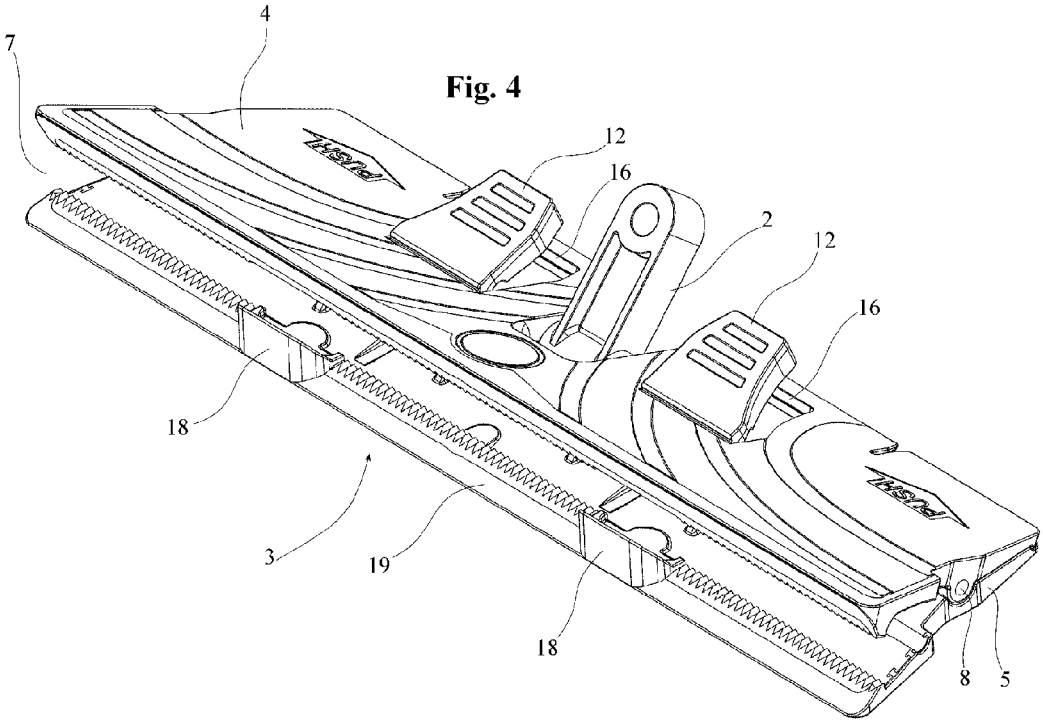
Figure 5:
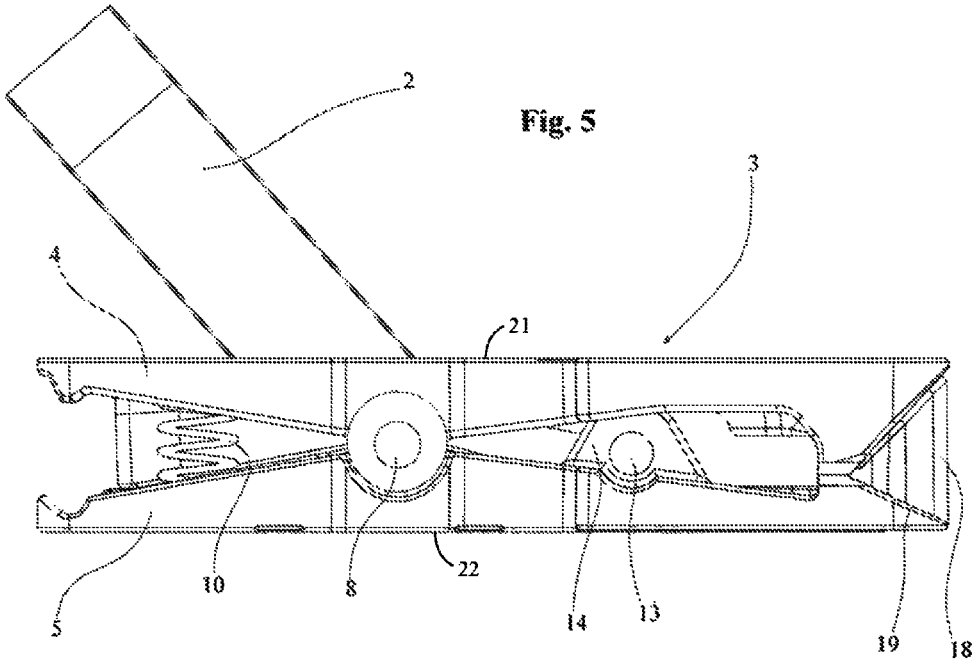
FIGS. 5 and 6 show a side plane view of FIGS. 1 and 2 respectively.
Figure 6:
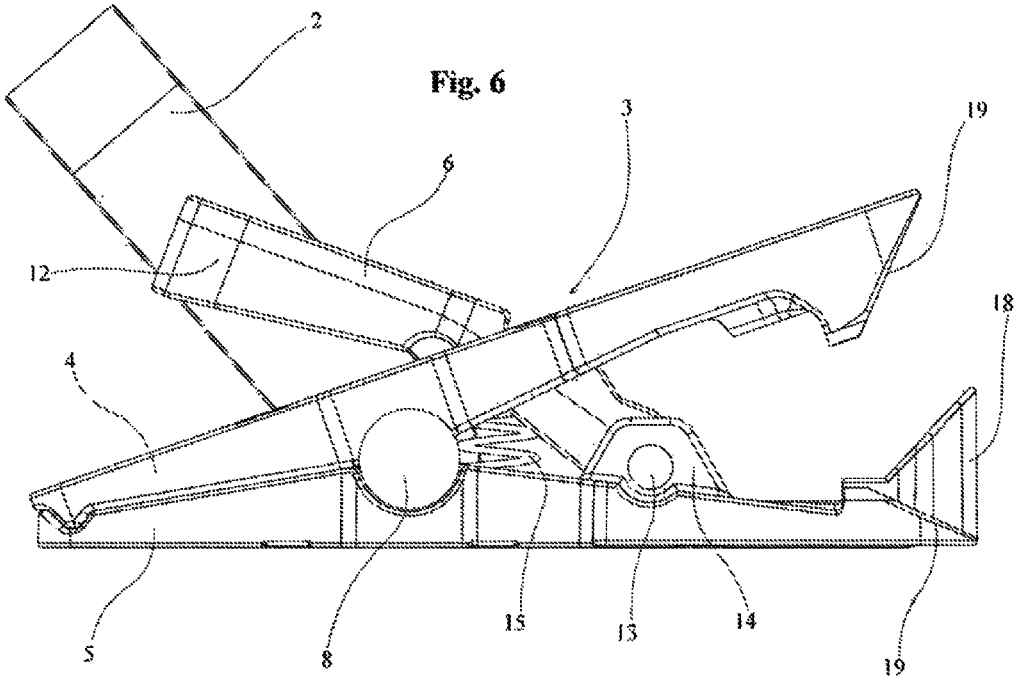
Figure 7:
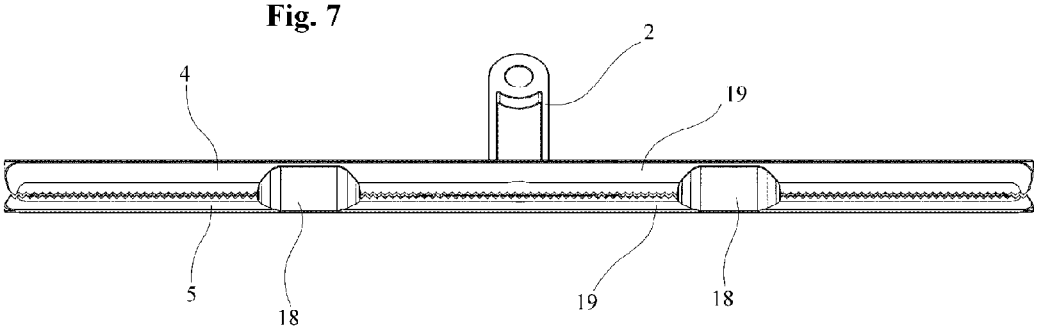
FIGS. 7 and 8 show a front plane view of the frame of FIGS. 1 and 2 respectively.
Figure 8:
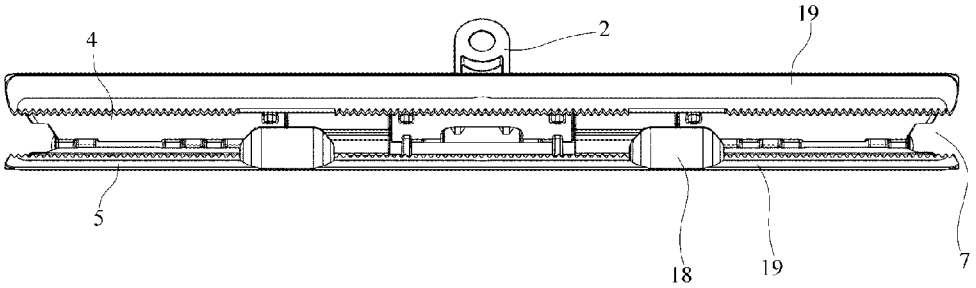
Figure 9:
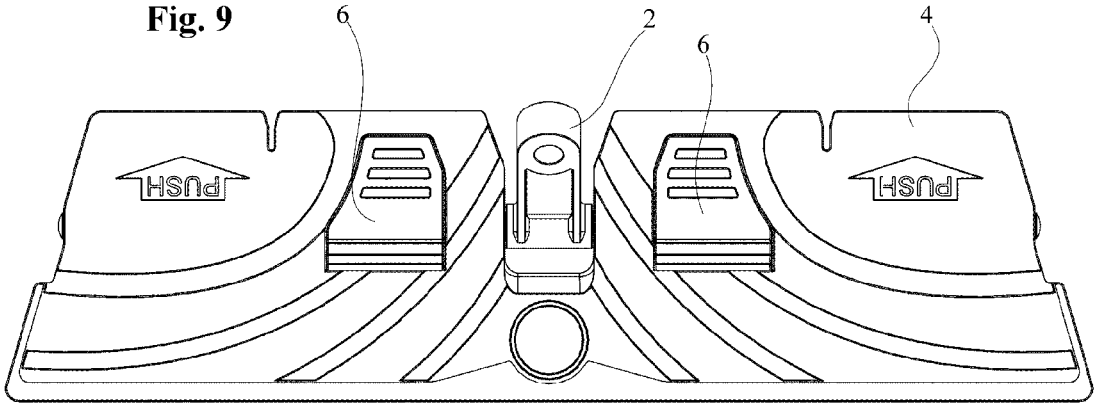
FIGS. 9 and 10 show a plane view from above of the frame of FIGS. 1 and 2 respectively.
Figure 10:
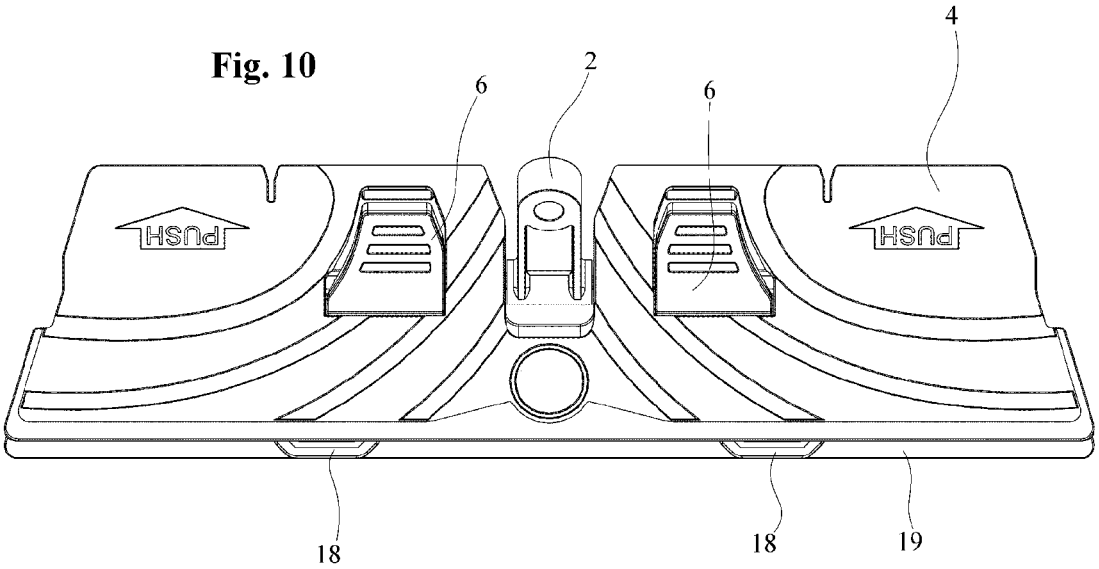
Figure 11:
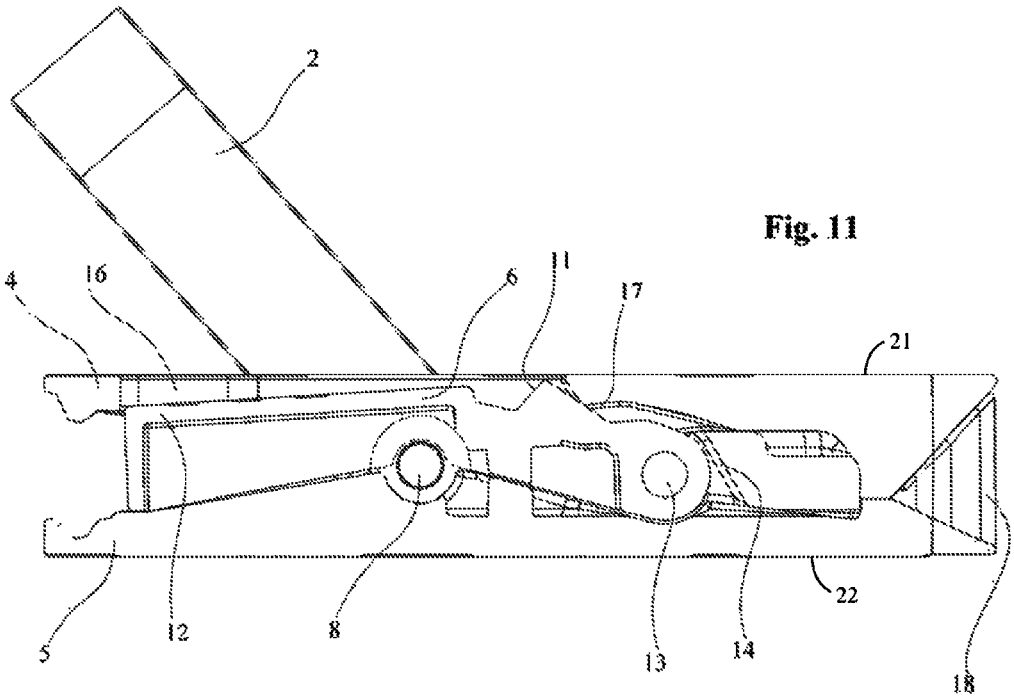
FIGS. 11 and 12 show a cross section view of the frame respectively of FIGS. 5 and 6 for an uncoupling button and perpendicular to the axis of the hinging between the two half-frames.
Figure 12:
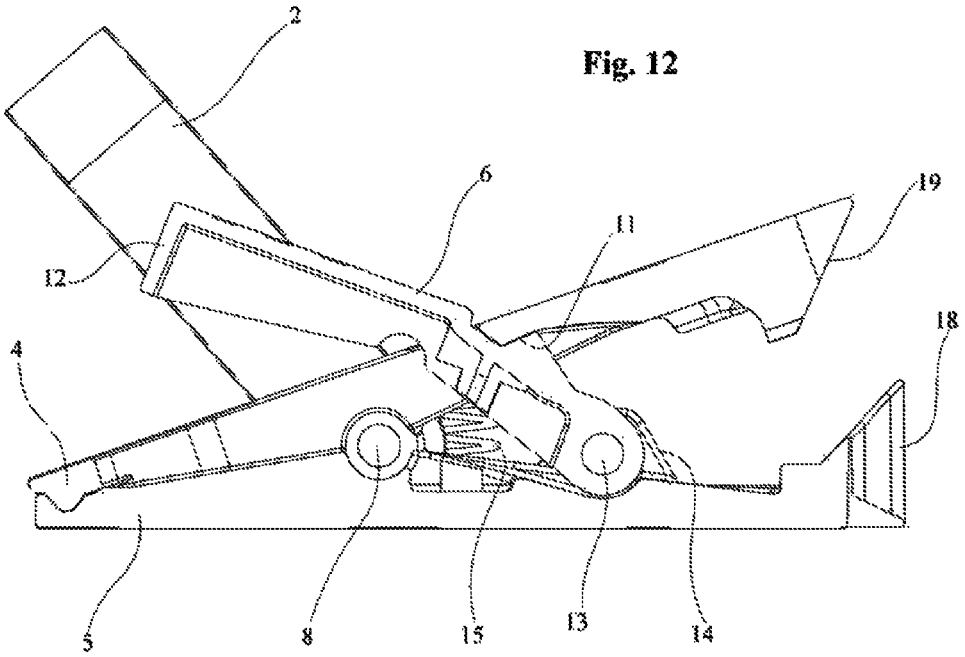
Figure 13:
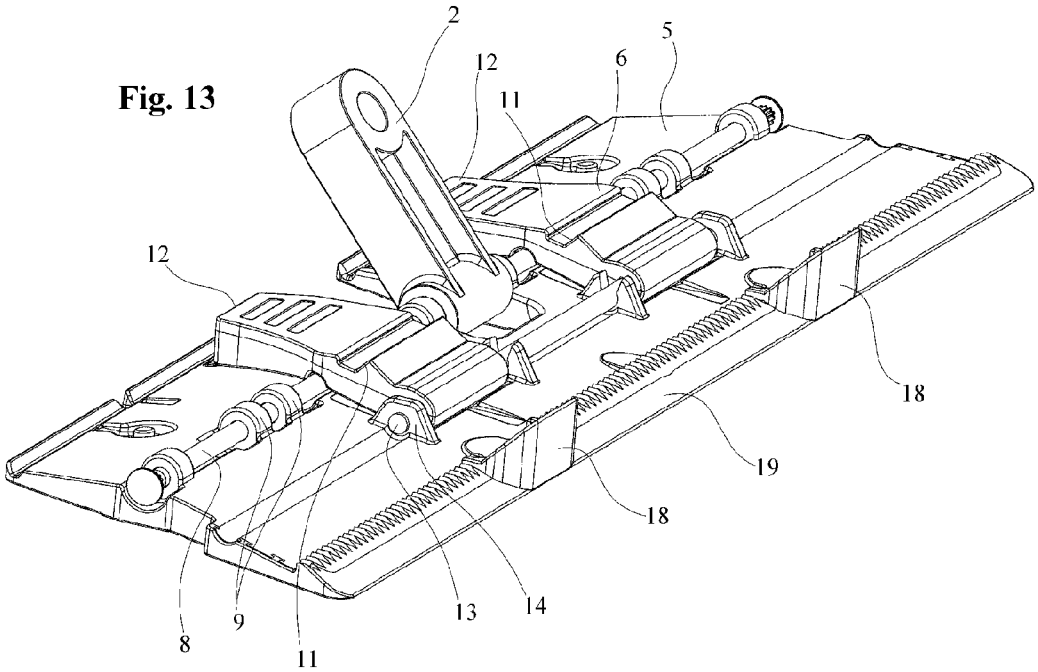
FIGS. 13 and 14 show the frame of FIGS. 1 and 2 respectively with the top half-frame removed.
Figure 14:
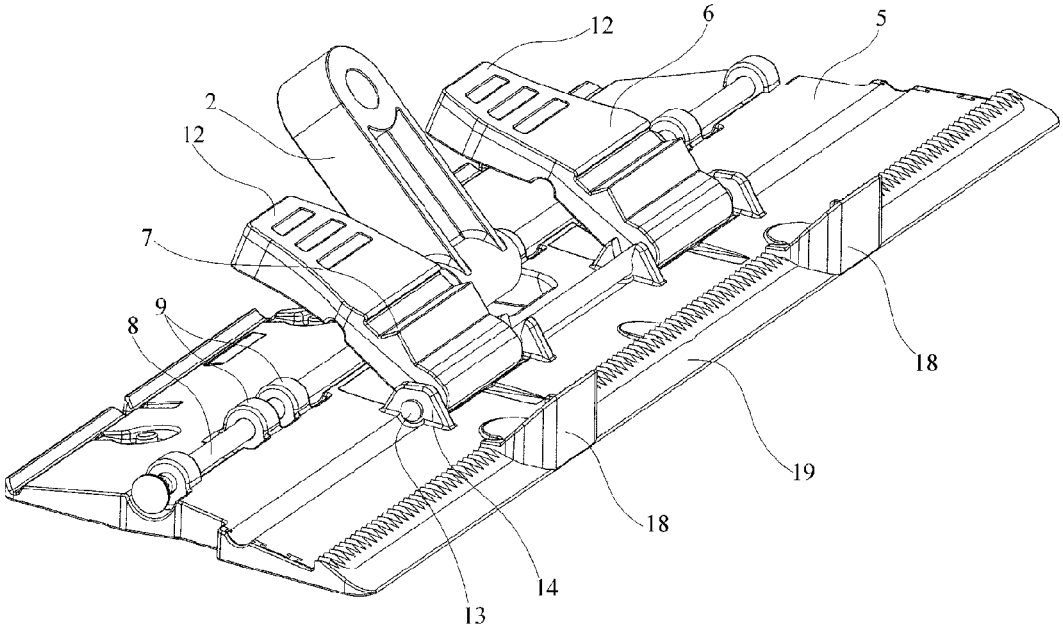

With reference to the diagrams, the mop base, indicated as a whole with 1, has a connection joint 2 for a handle, hinged on a frame 3 that is the object of the invention.

Said frame 3 is composed basically of two half-frames 4, 5 that are hinged to each other to provide limited reciprocal rotation and one or more retaining elements 6 (or uncoupling devices, for example the one shown in PD2011A000259), capable of maintaining the two above mentioned frames 4, 5 in a first fixed open position for gripping and releasing the mop in the grasping mouth 7 and a second stable condition with the mouth 7 closed holding an edge of the mop. The two half-frames 4, 5 each including a substantially planar outer surface 21, 22.

In a central and centered position the frame has a connection joint 2 for attaching to the handle.

Preferably, but not essential, this joint 2 is hinged to the same hinging pin 8 of the two half-frames 4, 5.

Near the center part of the inner surface of each half-frame there are one or more housings 9 of the pin 8 for the partial and limited rotation of the two half-frames 4, 5.

Normally, because there are elastic components 10, sufficiently set away from the above-mentioned hinging pin 8, which push in a divergent manner from one side of the two half-frames 4, 5, causing the closure of the side opposite the hinging, the frame 3 has the mouth 7 closed gripping a mop along the edge of the two half-frames 4, 5.

The open stable condition of the mouth 7 is achieved through the counter action of the above-mentioned elastic components 10, normally activated using simple pressure on the external side opposite the one said elastic components 10 act on. In other words, the elastic components 10 cause a force on an inside surface of the half-frames 4, 5. A force on the external surface of the half-frames 4, 5 opposite the inside surface where the elastic components 10 apply a resilient force, opens the mouth 7 as the sides of the half-frames 4, 5, opposite the mouth 7, come close together.

Near the maximum opening of the mouth 7 there is a retention device 11, of the type described in PD2011A000259, already mentioned previously and included for reference, on the retention element (or uncoupling device) that keeps said second configuration with the mouth 7 open stable.

Said uncoupling device 6 is composed of a lever 12, fitted with said retention device 11, hinged on a pin 13 whose housings 14 are joined to one half-frame, and of second elastic components 15 that tighten to rotate said lever 12 with respect to that half-frame on which it is hinged, so as to be able to rise up through and beyond an aperture 16 on the opposite half-frame.

When the frame 3 has the mouth 7 closed, said lever 12 is contained inside the profile of said aperture 16 and does not stick out from the outer surface 21 of the relative half-frame.

The stable condition of the frame 3 in an open configuration is attained when, during the lowering of a half-frame to open its mouth 7, the uncoupling device 6, in whose intermediate part of the lever 12 there is a retention device 11, configured as a retaining tooth, rotates, lifting up and putting said retention device 11 underneath a housing 17 specially provided for in the lowered half-frame. This retains the mop head with the clasping mouth 7 in a stable open configuration with the retention device 11 impeding the mouth 7 from returning to the closed condition.

Only after pressure from the lever 12 of said uncoupling device 6, countering the force exercised by said second elastic components 15, with the rotation and shifting of said retention device 11, until it comes out of its housing 17, is the half-frame free under the action of said elastic components 10 to rotate to make the frame 3 take on the stable condition of the mouth 7 closed.

We should add that applying this pressure on the lever 12 is very easy since said lever 12 protrudes from the surface defined by the top outer surface 21 of the top half-frame 4, thereby facilitating the rising up of this lever 12 from the profile of the half-frame 4, both for identification and operation; therefore the operator is immediately aware on which part he has to apply the pressure to allow the mouth 7 of the frame 3 to close.

Also the opening of the mouth 7 of the frame 3 is easy to achieve.

In fact, thanks to the movement and the hinging of the various components, the operator can easily act on a large surface to open the mouth 7 of the frame 3, (no other control is available since the lever 12 is contained inside the outer profile of the half-frames).

The lowering and the retention of the uncoupling device 6 inside the profile of the aperture 16 and not protruding beyond the outer surface 21 of the half-frame, takes place following the sliding of an edge of the aperture 16 on an inclined profile of the lever 12.

Another beneficial feature attained with said configuration of the frame 3 with the mouth 7 closed consists of a configuration of the frame 3 whose larger and opposite outer surfaces 21, 22, during the work configuration, have no unevenness and/or protruding element, but rather have a pair of practically smooth surfaces 21, 22, parallel to each other.

The operator therefore can immediately assess the state of the mop base, and use it safely, without any fear that it might get stuck underneath any furniture.

This beneficial arrangement of the half-frames 4, 5 with their respective parallel large outer surfaces 21, 22 allow you to wring the mop applied to the frame, even when placed against one of said surfaces, without the risk of an unexpected and inconvenient detachment of said mop.

Another benefit of this arrangement and configuration is that the controls, namely the areas to be operated for opening and closing the mouth 7 of the frame 3, are always to be found facing the operator and are available in a preeminent manner with respect to the context, namely practically exposing just the opening control when the mouth 7 is closed and raising just the release control when the mouth 7 is already open.

No problem is caused by the inadvertent pushing on the side of the mouth, since the two half-frames 4, 5 are fitted with appropriate and opportunely sized limiters 18 near the pressure edge 19 of the mouth 7, which can withstand the above-mentioned unexpected stresses.

Said unexpected stresses can originate from an inattentive operator, who acts on the wrong side of the frame 3, as well as during the wringing operations where the frame 3 is inserted only partially inside the wringer.

These limiters 18, in addition to the above-mentioned function, also help the operator to align and correctly engage the mop fitted with complementary notches on the profile along the edge to be attached to the mouth 7 of the frame 3, carrying out the role of counterpart of the mop inserted and to be inserted.

The mouth 7, because it has a pressure edge 19 with inclined surfaces can engage a correctly positioned mop that is directly on the floor, avoiding any manual coupling operation with handling the mop, by simply setting the frame 3 with the mouth 7 open at the edge of the mop, which entering and partially surmounting the pressure edge 19 of the mouth 7 until the recesses on the mop encounter the respective limiters 18, and thanks to these very limiters 18 the mop to be applied to the frame centers itself.

What is claimed is:

1. An improved mop base, comprising:

a pair of substantially flat half-frames each including a substantially planar outer surface;

at least one hinged connection reciprocally hinging the pair of substantially flat half-frames together along a common longitudinal axis, wherein the at least one hinged connection is located a distance away from a first edge of the pair of substantially flat half-frames such that an opening portion of each of the pair of substantially flat half-frames is formed between the first edge and the hinged connection;

a force applied to the opening portion moves the first edge of each of the pair of substantially flat half-frames together to cause a clasping mouth of the pair of substantially flat half-frames to open, the clasping mouth being located at a second edge, opposite the first edge, of the pair of substantially flat half-frames;

the clasping mouth is capable of retaining a free edge of a mop inside, the clasping mouth formed by a pair of longitudinal edges of corresponding sides of each half-frame, each half-frame mutually rotatable so that the mop base can be configured into a first open configuration and a second closed configuration; and with the mop base in the second closed configuration, the outer surfaces of said half-frames are mutually parallel.

2. The improved mop base according to claim 1 wherein both outer surfaces of each half-frame can be directed to a floor to become active mopping surfaces.

3. The improved mop base according to claim 1 wherein the mop base can be inserted, together with a mop fixed against one of the large outer surface of one of the two half-frames, into a wringer mop for flat surfaces for wringing said mop, the mop maintaining attachment to the mop base.

4. The improved mop base according to claim 1, further including an uncoupling device for uncoupling the half-frames from the first open configuration to the second closed configuration, the uncoupling device remaining inside a profile of the outer surfaces of the two half-frames when the mop base is in the closed position and during mop wringing, without the uncoupling device protruding from said profile.

5. The improved mop base according to claim 4 wherein the uncoupling device comprises a lever and an elastic device, the lever being hinged to one of the half-frames with an axis parallel to the common longitudinal axis.

6. The improved mop base according to claim 1 wherein an end part of each half-frame opposite the clasping mouth acts as a lever arm, which when pressed mutually together opens the clasping mouth.

7. The improved mop base according to claim 1 further including near the longitudinal edges of the clasping mouth a plurality of limiters capable of withstanding unexpected stresses on the side of the mouth.

8. The improved mop base according to claim 7 wherein the limiters are each reference locator edges corresponding with the mop.

9. The improved mop base according to claim 1 wherein the longitudinal edges of the clasping mouth includes a plurality of inclined surfaces capable of engaging a correctly positioned and arranged mop on the floor.

10. The improved mop base of claim 1, wherein the clasping mouth is resiliently urged into the second closed configuration by at least one elastic member.

11. A mop base, comprising:

a first half frame having a substantially planar first outer surface disposed between a first half frame first longitudinal edge and a first half frame second opposite longitudinal edge;

a second half frame disposed adjacent the first half frame, the second half frame having a substantially planar second outer surface disposed between a second half frame first longitudinal edge and a second half frame second opposite longitudinal edge;

a clasping mouth formed between the first half frame first longitudinal edge and the second half frame first longitudinal edge, the clasping mouth pivotable about a pivot axis between an open configuration and a closed configuration;

wherein the pivot axis is disposed longitudinally between the first and second half frames and is disposed a distance away from the first half frame second longitudinal edge and the second half frame second longitudinal edge, and with the mop base in the closed configuration, the first and second outer surfaces of said half-frames are mutually parallel.

12. The mop base of claim 11, wherein the clasping mouth is resiliently urged into the closed configuration by at least one elastic member.

13. The mop base of claim 11, further comprising at least one lever resiliently urged into a retention position, where the at least one lever maintains the open configuration of the clasping mouth when a force is applied along the second longitudinal edges of the first and second half frames to bring the second longitudinal edges together.

14. The mop base of claim 13, further comprising a lever elastic member for resiliently urging the lever into the retention position.

15. The mop base of claim 13, further comprising an uncoupling portion of the lever, wherein a force applied to the uncoupling portion of the lever causes the lever to move out of the retention position and allows the clasping mouth to resiliently close.

* * * * *